US008375662B2

(12) United States Patent
Dolby

(10) Patent No.: US 8,375,662 B2
(45) Date of Patent: Feb. 19, 2013

(54) INTERLOCKING GLASS SETTING BLOCK SUPPORT

(75) Inventor: Jeffrey Scott Dolby, Buford, GA (US)

(73) Assignee: Alcoa Inc., Pittsburgh, PA (US)

( * ) Notice: Subject to any disclaimer, the term of this patent is extended or adjusted under 35 U.S.C. 154(b) by 21 days.

(21) Appl. No.: 13/150,542

(22) Filed: Jun. 1, 2011

(65) Prior Publication Data

US 2011/0296779 A1 Dec. 8, 2011

Related U.S. Application Data

(60) Provisional application No. 61/351,402, filed on Jun. 4, 2010.

(51) Int. Cl.

| | |
|---|---|
| ***E04H 1/00*** | (2006.01) |
| ***E04H 14/00*** | (2006.01) |
| ***E04H 3/00*** | (2006.01) |
| ***E04H 5/00*** | (2006.01) |
| ***E04H 6/00*** | (2006.01) |

(52) U.S. Cl. ..... 52/235; 52/234

(58) Field of Classification Search ..... 52/235, 52/236.3, 238.1

See application file for complete search history.

(56) References Cited

U.S. PATENT DOCUMENTS

| | | | | |
|---|---|---|---|---|
| 4,738,065 | A * | 4/1988 | Crandell | 52/235 |
| 4,873,806 | A * | 10/1989 | Jeschke | 52/235 |
| 4,899,508 | A * | 2/1990 | Biebuyck | 52/235 |
| 5,036,637 | A * | 8/1991 | Biebuyck | 52/235 |
| 5,058,344 | A * | 10/1991 | Biebuyck | 52/235 |
| 5,065,557 | A * | 11/1991 | Laplante et al. | 52/235 |
| 5,381,637 | A * | 1/1995 | Farag | 52/204.595 |
| 5,408,784 | A * | 4/1995 | Wruck et al. | 49/489.1 |
| 5,632,125 | A * | 5/1997 | Osanai | 52/235 |
| 6,105,973 | A * | 8/2000 | Butler et al. | 277/644 |
| 2005/0000181 | A1 * | 1/2005 | Grunewald | 52/459 |
| 2005/0188631 | A1 * | 9/2005 | Neal | 52/204.5 |
| 2010/0122503 | A1 * | 5/2010 | Davies et al. | 52/309.1 |

* cited by examiner

*Primary Examiner* — Mark Wendell

(74) *Attorney, Agent, or Firm* — Greenberg Traurig, LLP

(57) ABSTRACT

Interlocking glass setting block supports are disclosed herein. In an embodiment, an interlocking glass setting block support includes a setting block chair; and a setting block, wherein the setting block chair comprises a lower face having at least one locking nub sufficiently designed, when positioned in a groove of a horizontal member of a curtain wall, to fit within a recess of the groove, wherein the setting block comprises a lower face and a back edge, wherein the back edge has at least one locking nub sufficiently designed, when positioned in the groove of the horizontal member of the curtain wall, to fit within a space created between the upper face of the setting block chair and an entry site of the groove, and wherein the lower face has a pressure sensitive adhesive, the pressure sensitive adhesive sufficiently designed to adhere the setting block to the setting block chair.

13 Claims, 6 Drawing Sheets

INTERLOCKING GLASS SETTING BLOCK SUPPORT

RELATED APPLICATIONS

This application claims the benefit of U.S. Provisional Application Ser. No. 61/351,402, filed Jun. 4, 2010, the entirety of this application is hereby incorporated herein by reference for the teachings therein.

BACKGROUND

A typical curtain wall includes a mullion structure in which mullions are fixed to a structural body of building, for example, such as concrete floor slab, steel framed truss or the like, transoms are stretched between adjacent mullions respectively, and panel members are mounted to a space defined by the adjacent two mullions and the transoms stretched therebetween. Such panel members are most often panes of glass, and often double pane glass sections, but other paneled building materials such as aluminum, granite, slate, or concrete are also utilized. Typically, the panel members are supported within the space with the aid of support chairs and setting blocks.

SUMMARY

According to aspects illustrated herein, in an embodiment there is disclosed an interlocking glass setting block support that includes a setting block chair; and a setting block, wherein the setting block chair comprises an upper face and a lower face, wherein the lower face comprises at least one locking nub sufficiently designed, when positioned in a groove of a horizontal member of a curtain wall, to fit within a recess of the groove, wherein the setting block comprises a lower face and a back edge, wherein the back edge has at least one locking nub sufficiently designed, when positioned in the groove of the horizontal member of the curtain wall, to fit within a space created between the upper face of the setting block chair and an entry site of the groove, and wherein the lower face has a pressure sensitive adhesive, the pressure sensitive adhesive sufficiently designed to adhere the setting block to the setting block chair. In an embodiment, the disclosed interlocking glass setting block support is sufficiently designed to support panel members of a curtain wall.

According to aspects illustrated herein, in an embodiment there is disclosed a curtain wall system that includes at least one interlocking glass setting block support of the present invention.

According to aspects illustrated herein, in an embodiment there is disclosed a glazing assembly that includes at least two insulating glass units and at least one interlocking glass setting block support of the present invention.

According to aspects illustrated herein, in an embodiment there is disclosed a curtain wall system that includes a curtain wall having a plurality of horizontal members stretched between adjacent vertical members, wherein at least one of the horizontal members has a front face, and a groove; and a setting block assembly having at least one setting block chair that includes a back edge; an upper face; and a lower face with at least one locking nub; and at least one setting block that includes a back edge with at least one locking nub; an upper face; and a lower face with a pressure sensitive adhesive, wherein the back edge of the setting block chair is positioned within the groove of the horizontal member of the curtain wall, wherein the locking nub of the setting block chair is positioned within a recess in the groove of the horizontal member of the curtain wall, wherein the setting block is positioned on the upper face of the setting block chair so that the locking nub on the back edge of the setting block is positioned within the groove of the horizontal member of the curtain wall and the pressure sensitive adhesive on the lower face of the setting block adheres the setting block to the upper face of the setting block chair, and wherein, when the setting block is adhered to the setting block chair, the setting block assembly is locked into position on the horizontal member such that the setting block assembly can not be removed from the horizontal member by lifting the setting block assembly or by pulling the setting block assembly alone.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention.

FIG. 1A is a perspective view of the interlocking glass setting block support. FIG. 1B is a side orthographic view of the interlocking glass setting block support;

FIG. 2A is a bottom orthographic view of the setting block chair and FIG. 2B is a side orthographic view of the setting block chair;

FIG. 3A is a bottom orthographic view of the setting block and FIG. 3B is a side orthographic view of the setting block;

FIG. 5A illustrates a partial vertical cut-away view of a screw spline toggle glazed curtain wall system according to an embodiment of the present invention, including a horizontal transom, insulating glass units (IGU), a setting block chair and a setting block. FIG. 5B illustrates a partial vertical cut-away view of a screw spline interface toggle glazed curtain wall system according to an embodiment of the present invention, including a horizontal transom, insulating glass units (IGU), a setting block chair and a setting block. FIG. 5C illustrates a partial vertical cut-away view of a screw spline interface tape toggle glazed curtain wall system according to an embodiment of the present invention, including a horizontal transom, insulating glass units (IGU), a setting block chair and a setting block.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the present invention.

DETAILED DESCRIPTION

As used herein, the terms "insulating glass", "double glazing", "Double Glazed Units", "Insulating Glass Unit" or "IGU" are used herein to refer to glass panes or "lites" that are assembled into units. The IGU includes a first glass lite and a second glass lite mounted parallel to and spaced from the first glass lite by a separator spacer.

As used herein, the term "mullion" refers to either a vertical mullion or a horizontal mullion (sometimes called "transom") of a curtain wall system.

As used herein, the term "screw spline toggle glazed curtain wall system" refers to an embodiment of a mullion structure or framing assembly application of the present invention.

As used herein, the term "screw spline interface toggle glazed curtain wall system" refers to an embodiment of a mullion structure or framing assembly application of the present invention with an applied interface and structural silicone.

As used herein, the term "screw spline interface tape toggle glazed curtain wall system" refers to an embodiment of a mullion structure or framing assembly application of the present invention with an applied interface and structural glazing tape.

While illustrative embodiments of the present invention described herein show "toggle glazed" curtain wall systems that include panel members with glass pane infills, it should be understood that an interlocking glass setting block support of the present invention can be used in other curtain wall systems, as well as other curtain wall applications where the panel members include other infills made up of nearly any exterior building element, including, but not limited to, fabric, metals (such as aluminum, stainless steel, and composite metals), composite materials (such as fiber-reinforced plastic), ceramics (such as travertine), and stones (such as calcium silicate, granite, marble, slate, travertine, limestone and concrete).

Figure 1A:
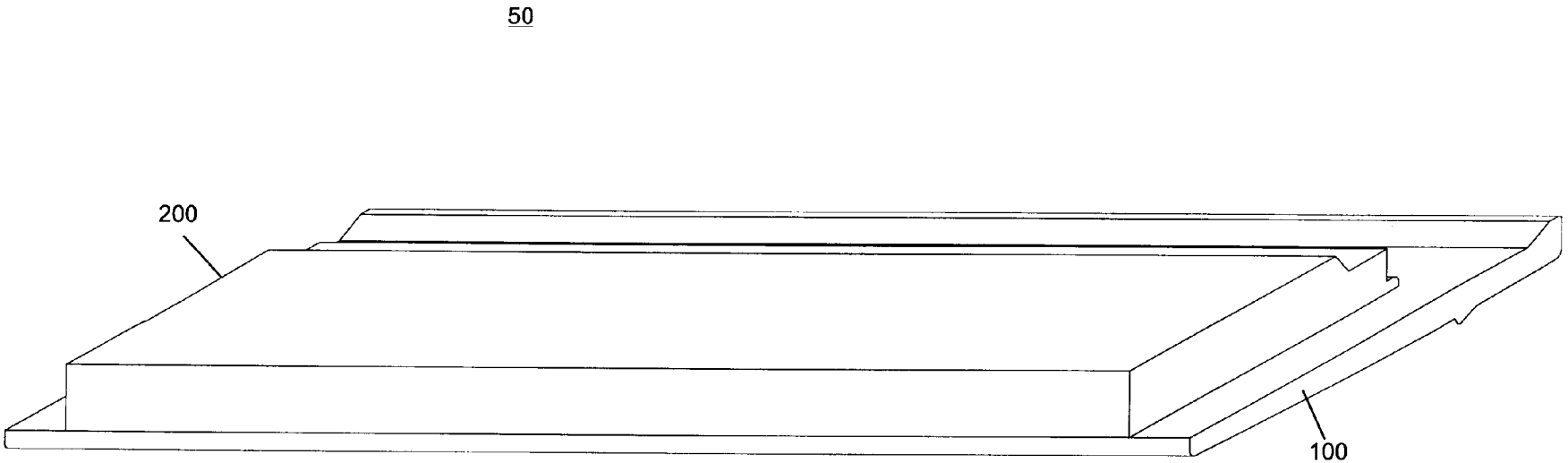
FIGS. 1A and 1B illustrate various views of an embodiment of an interlocking glass setting block support of the present invention. The interlocking glass setting block support includes a setting block chair and a setting block.
Figure 1B:
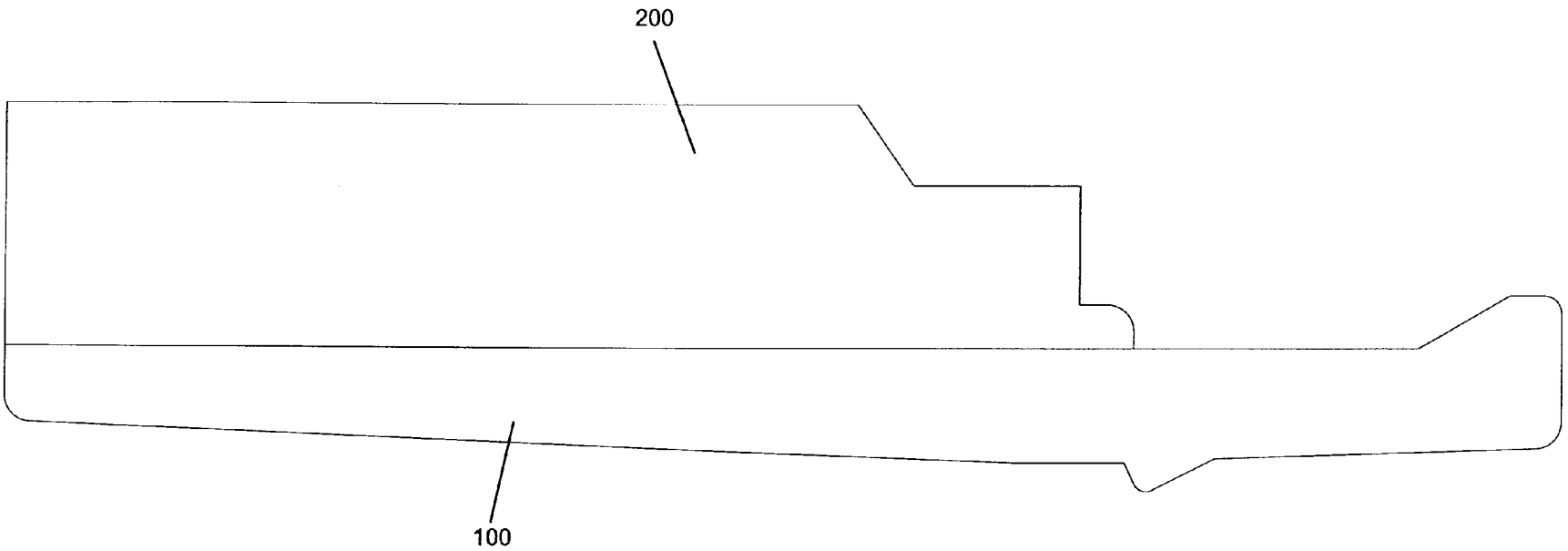
Figure 2A:
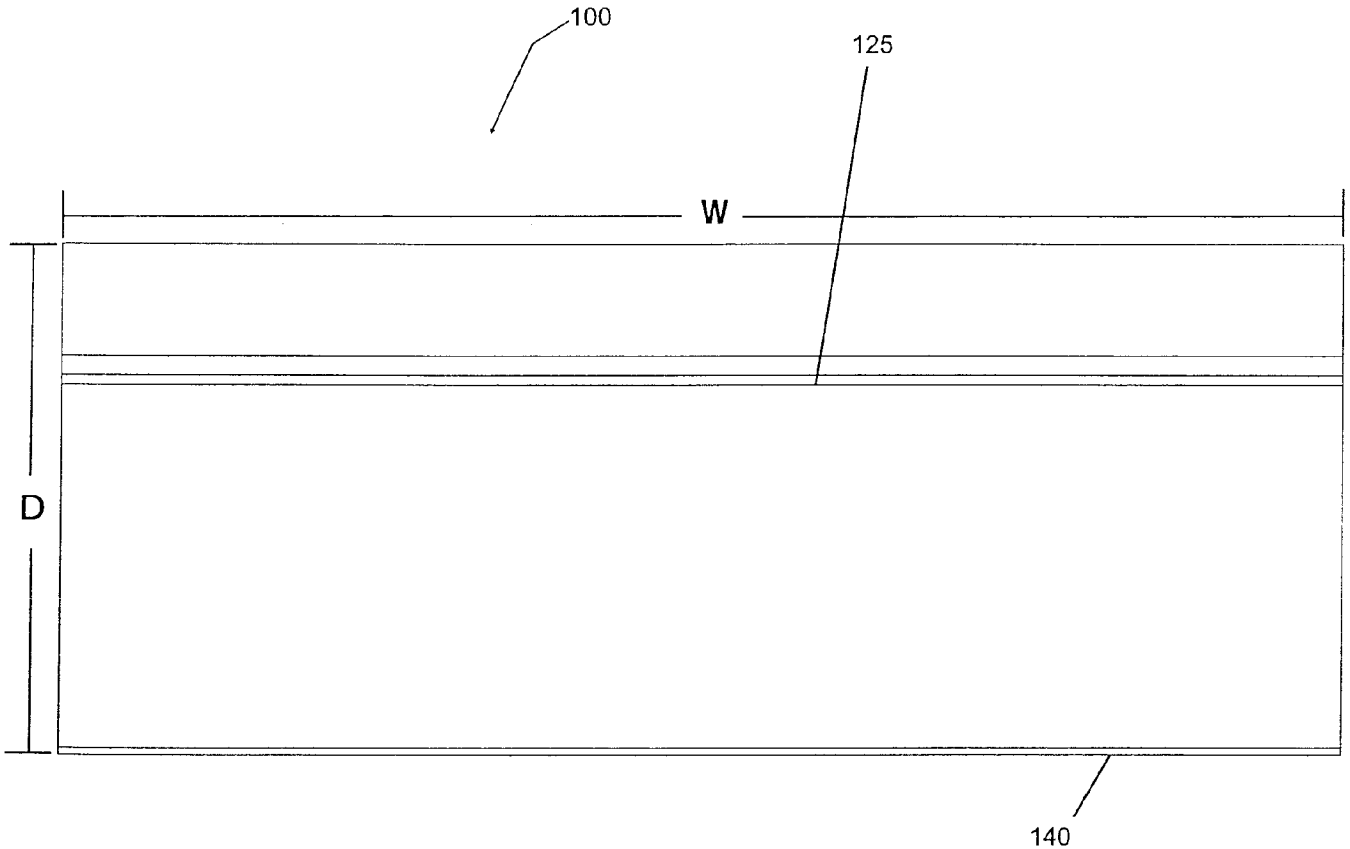
FIGS. 2A and 2B illustrate various views of the setting block chair of FIG. 1A.
Figure 2B:
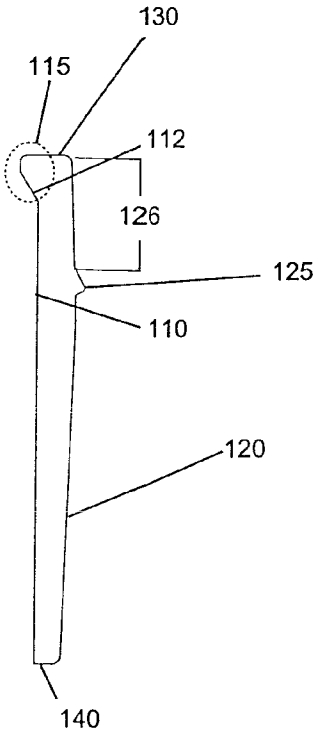
Figures 3A, 3B:
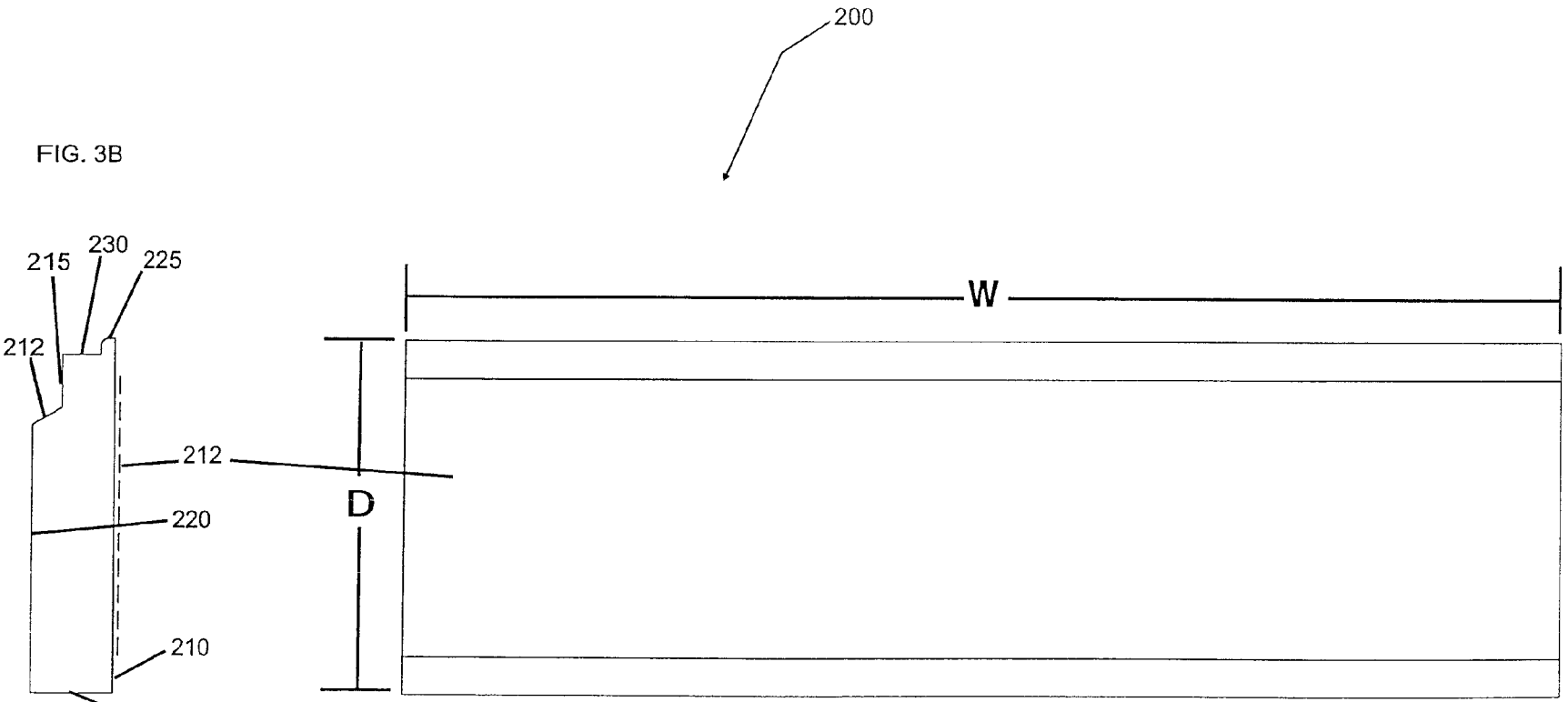
FIGS. 3A and 3B illustrate various views of the setting block of FIG. 1A.

FIGS. 1A and 1B, in conjunction with FIG. 2A, FIG. 2B, FIG. 3A and FIG. 3B, illustrate various views of an embodiment of an interlocking glass setting block support 50 of the present invention. In an embodiment, the interlocking glass setting block support 50 is sufficiently designed to support panel members of a curtain wall system. In an embodiment, the curtain wall is a toggle glazed curtain wall system. In an embodiment, the toggle glazed curtain wall system is a screw spline toggle glazed curtain wall system. In an embodiment, the toggle glazed curtain wall system is a screw spline interface toggle glazed curtain wall system. In an embodiment, the toggle glazed curtain wall system is a screw spline interface tape toggle glazed curtain wall system. The interlocking glass setting block support 50 includes a setting block chair 100 (FIGS. 2A and 2B) and a setting block 200 (FIGS. 3A and 3B). In an embodiment, a glazing assembly for a building includes at least one interlocking glass setting block support 50 of the present invention. In an embodiment, a glazing assembly for a building includes two or more glass setting block supports 50 of the present invention. In an embodiment, a toggle glazed curtain wall system for a building includes at least one interlocking glass setting block support 50 of the present invention. In an embodiment, a toggle glazed curtain wall system for a building includes two or more interlocking glass setting block supports 50 of the present invention. In an embodiment, the interlocking glass setting block support 50 is sufficiently designed and configured to support and level window panes and the like. The setting block chair 100 is sufficiently shaped and designed to be removably engaged with a horizontal member of a curtain wall system. In an embodiment, the setting block chair 100 is removably engaged with a horizontal member of a curtain wall system during any of the installation processes. In an embodiment, the setting block chair 100 is removably engaged with a horizontal member of a curtain wall system after completion of the installation process.

As illustrated in FIGS. 2A and 2B, the setting block chair 100 includes an upper face 110, a front edge 140, a back edge 130 and a lower face 120. The lower face 120 includes at least one locking nub 125. In an embodiment, the locking nub 125 is continuous and spans the entire width, W, of the setting block chair 100, as illustrated in FIG. 2A. In an embodiment, a plurality of locking nubs 125 are positioned on the lower face 120 at various intervals. The locking nub(s) 125 are sufficiently designed to fit within a recess of a groove of a horizontal member of a curtain wall system. When installed in a curtain wall system, a back lower face 126 of the setting block chair 100 engages a groove in a horizontal member of the curtain wall system, and the locking nub 125 is sufficiently designed and configured to releasably engage a recess in the groove of the horizontal member of the curtain wall system to secure the setting block chair 100 to the horizontal member. The setting block chair 100 includes an engaging area 115 that includes a ramp section 112, which will be described with relation to FIG. 4A. In an embodiment, the width, W, of the setting block chair 100 is between about 4 inches and about 5 inches, although other widths are contemplated for a given application. In an embodiment, the depth, D, of the setting block chair 100 is between about 1 inch and about 3 inches, although other depths are contemplated for a given application. In an embodiment, the setting block chair 100 is manufactured from a corrosion-resistant material selected from the group consisting of metals and ceramics. In an embodiment, the setting block chair 100 is manufactured from a material that is conventionally considered corrosive and subsequently coated with a corrosion-resistant material to impart resistance to corrosion. In an embodiment, the setting block chair 100 is manufactured from an aluminum alloy. In an embodiment, the setting block chair 100 is manufactured from a stainless steel. In an embodiment, the setting block chair 100 is manufactured from a ceramic.

As illustrated in FIGS. 3A and 3B, the setting block 200 includes a lower face 210, a front edge 240, a back edge 230, a first top face 220 and a second top face 215, wherein a ramp portion 212 between the first top face 220 and the second top face 215 positions the second top face 215 lower than the first top face 220. The setting block 200 also includes at least one locking nub 225 at the back edge 230. In the embodiment illustrated in FIGS. 3A and 3B, the setting block 200 includes a pressure sensitive adhesive (PSA) 212 on the lower face 210 that is covered by a liner for protection prior to the installation of the setting block 200. In an embodiment, the PSA 212 is approximately the full width of the setting block 200. In an embodiment, the PSA 212 is about 1.000 inches in depth, although other depths are contemplated for a given application. In an embodiment, the locking nub 225 is continuous and spans the entire width, W, of the setting block 200, as illustrated in FIGS. 3A and 3B. In an embodiment, a plurality of locking nubs 225 are positioned at the back edge 230 at various locations. When installed in a curtain wall system having a setting block chair 100 of the present invention, the lower face 210 of the setting block 200 engages at least a portion of the upper face 110 of the setting block chair 100, as will be described below. Further, when installed in a curtain wall system having a setting block chair 100 of the present invention, the locking nub 225 fits within a space created between the upper face 110 of the setting block chair 100 and an entry site of the groove of the horizontal member, as described in detail below. In an embodiment, the width, W, of the setting block chair 200 is between about 4 inches and about 5 inches, although other widths are contemplated for a given application. In an embodiment, the width, W, of the setting block 200 is about the same as the width, W, of the setting block chair 100. In an embodiment, the depth, D, of the setting block 200 is between about 1 inch and about 2.5 inches, although other lengths are contemplated for a given application. In an embodiment, the setting block 200 is manufactured from a corrosion-resistant material selected from the group consisting of elastomers, synthetic rubbers and polymers. In an embodiment, the setting block 200 is manufactured from a polymer. In an embodiment, the setting block 200 is manufactured from polyvinyl chloride (PVC). In an embodiment, the setting block 200 is manufactured from silicone. In an embodiment, the setting block 200 is manufactured from ethylene propylene diene Monomer (EPDM). In an embodiment, the setting block 200 is manufactured from neoprene. In an embodiment, the setting block 200 is manufactured from a polymer material, such as a homopolymer or a copolymer. In an embodiment, the polymer is a polyvinyl chloride homopolymer. In an embodiment, the setting block 200 is manufactured from a polymer material allowing the setting block 200 to directly come in contact with the glass of an IGU.

Figure 4B:
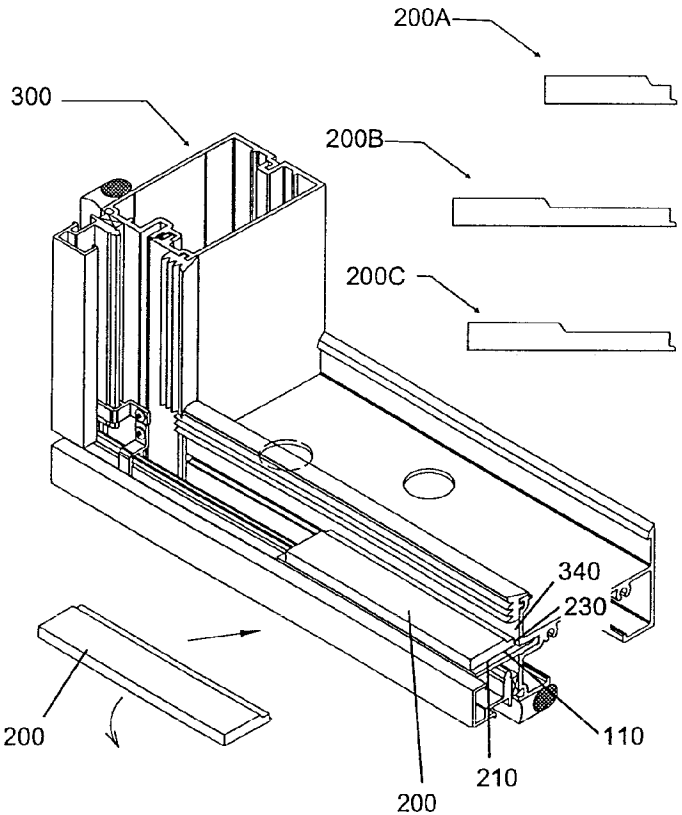
FIGS. 4A and 4B are pictorial perspective views of a representative portion of a toggle glazed curtain wall system as viewed from the exterior according to an embodiment of the present invention, showing installation of a setting block chair of the present invention (FIG. 4A) and a setting block of the present invention (FIG. 4B)
Figure 4A:
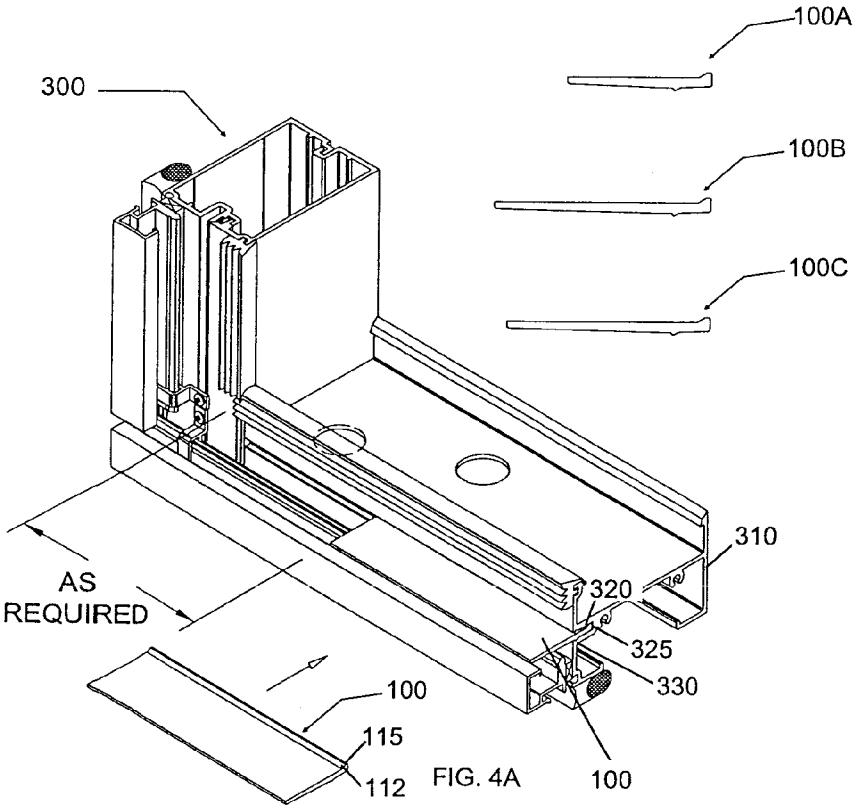

FIGS. 4A and 4B show representative portions of toggle glazed curtain wall systems according to an embodiment of the present invention, including a setting block chair 100 and a setting block 200. FIG. 4A is a pictorial perspective view of an embodiment of an installation process for installing a setting block chair 100 of the present invention. FIG. 4B is a pictorial perspective view of an embodiment of an installation process for installing a setting block 200 of the present invention. As illustrated in the various figures, the setting block chair 100 and the setting block 200 can be manufactured to have varying depths, D, according to the type of curtain wall system in which the setting block chair 100 and the setting block 200 are to be installed. The setting block chairs 100A, 100B and 100C show varying depths, D. The setting blocks 200A, 200B and 200C show varying depths, D. As illustrated in FIGS. 4A and 4B, the setting block chair 100 is rotated so that the engaging area 115 can slide within a groove 320 of a horizontal member 310 of the toggle glazed curtain wall system 300 until the back edge 130 of the setting block chair 100 engages a back edge 325 of the groove 320. Once the back edge 130 engages the back edge 325 of the groove 320, the setting block chair 100 is counter-rotated until the locking nub 125 is locked within a recess 330 of the groove 320. To install a setting block 200 of the present invention in the toggle glazed curtain wall system 300, the liner for the PSA 212 is removed from the lower face 210, the setting block 200 is rotated onto the setting block chair 100 until the locking nub 225 slides into a space defined between the upper face 110 and the groove 320 of the horizontal member 310. The setting block 200 is rotated down until the lower face 210 of the setting block 200 contacts the upper face 110 of the setting block chair 100. Pressure is applied to the top of the setting block 200 to adhere the lower face 210 of the setting block 200 to the upper face 110 of the setting block chair 100 using the PSA 212.

Figure 5A:
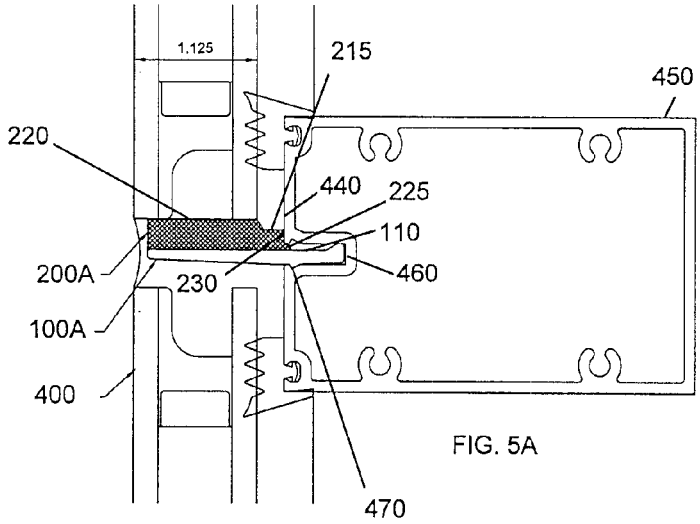
FIGS. 5A-5C illustrate partial vertical cut-away views of horizontal members of toggle glazed curtain wall systems according to embodiments of the present invention, including a setting block chair and a setting block.
Figure 5B:
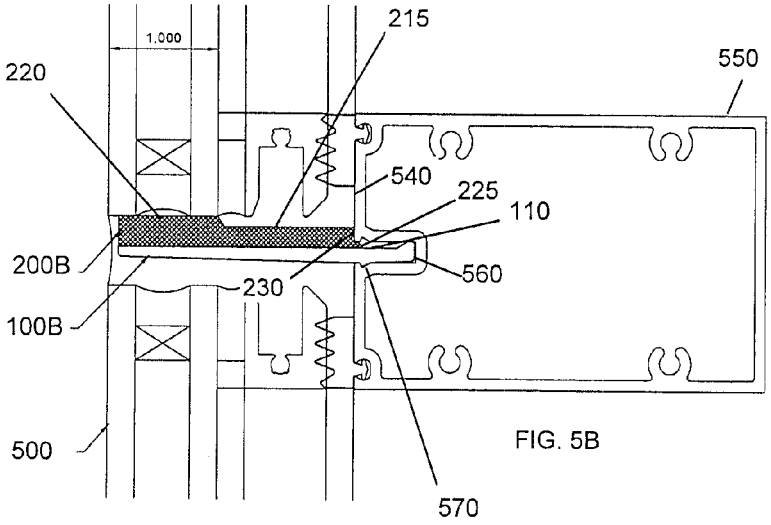
Figure 5C:
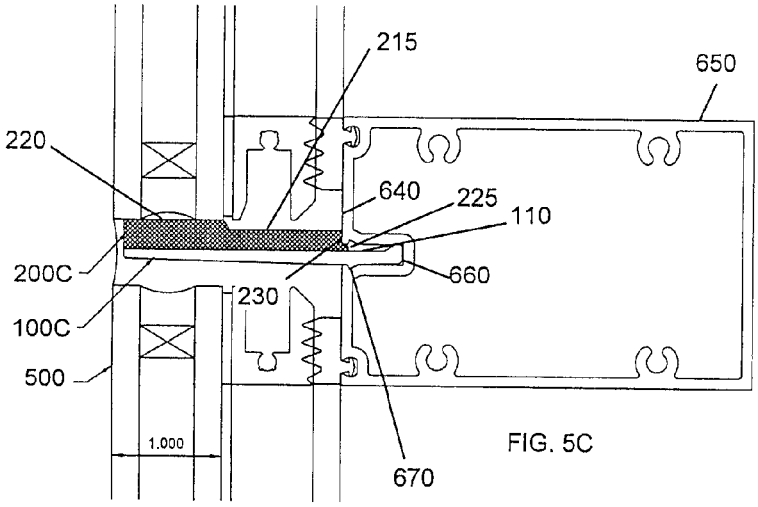

FIGS. 5A-5C illustrate partial vertical cut-away views of toggle glazed curtain wall systems horizontal members 450, 550 and 650 according to an embodiment of the present invention, including interlocking glass setting block supports having setting block chairs 100A, 100B and 100C and setting blocks 200A, 200B and 200C. FIG. 5A illustrates a partial vertical cut-away view of a screw spline toggle glazed curtain wall system according to an embodiment of the present invention, including a horizontal transom 450, insulating glass units (IGU) 400 and a setting block chair 100A and a setting block 200A of the present invention. Each IGU 400 illustrated in FIG. 5A is shown at a 1.125 inch thickness, but it should be understood that the application of an interlocking glass setting block support of the present invention is not limited to any specific thickness IGU. In an embodiment, each IGU 400 comprises two panes of glass lites attached to a structural separator spacer with a structural adhesive sealant, such as structural silicone adhesive. The transom 450 has a groove 460. In an embodiment, the groove 460 has a back edge configured for direct engagement with the back edge 130 of the setting block chair 100A. The transom 450 has a front face 440 for engaging with the back edge 230 of the setting block 200A. Air seal gaskets may be positioned between the transom 450 and each of the IGU. A silicone weatherseal may be positioned between the adjacent edges of the outer glass lite. As illustrated, the setting block chair 100A is rotated so that the engaging area 115 can slide within the groove 460 of the horizontal member 450 of the toggle glazed curtain wall system until the back edge 130 of the setting block chair 100A engages a back edge of the groove 460. Once the back edge 130 engages the back edge of the groove 460, the setting block chair 100A is counter-rotated until the locking nub 125 is locked within a recess 470 of the groove 460. To install the setting block 200A in the toggle glazed curtain wall system, the liner for the PSA 212 is removed from the lower face 210, the setting block 200A is rotated onto the setting block chair 100A until the locking nub 225 slides into a space defined between the upper face 110 and the groove 460 of the horizontal member 450. The setting block 200A is rotated down until the lower face 210 of the setting block 200A contacts the upper face 110 of the setting block chair 100A. Pressure is applied to the top of the setting block 200A to adhere the lower face 210 of the setting block 200A to the upper face 110 of the setting block chair 100A using the PSA 212.

FIG. 5B illustrates a partial vertical cut-away view of a screw spline interface toggle glazed curtain wall system according to an embodiment of the present invention, including a horizontal transom 550, insulating glass units (IGU) 500 and a setting block chair 100B and a setting block 200B of the present invention. Each IGU 500 illustrated in FIG. 5B is shown at a 1.000 inch thickness, but it should be understood that the application of an interlocking glass setting block support of the present invention is not limited to any specific thickness IGU. In an embodiment, each IGU 500 comprise two panes of glass lites attached to a structural spacer with a structural adhesive, such as structural silicone adhesive. Each IGU 500 engages an interface channel with a structural adhesive, such as structural silicone adhesive, and a glazing tape, such as acrylic glazing tape. The transom 550 has a groove 560. In an embodiment, the groove 560 has a back edge configured for direct engagement with the back edge 130 of the setting block chair 100B. The transom 550 has a front face 540 for engaging with the back edge 230 of the setting block 200B. Air seal gaskets may be positioned between the transom 550 and the interface. A silicone weatherseal may be positioned between the adjacent edges of the outer glass lite. As illustrated, the setting block chair 100B is rotated so that the engaging area 115 can slide within the groove 560 of the horizontal member 550 of the toggle glazed curtain wall system until the back edge 130 of the setting block chair 100B engages a back edge of the groove 560. Once the back edge 130 engages the back edge of the groove 560, the setting block chair 100A is counter-rotated until the locking nub 125 is locked within a recess 570 of the groove 560. To install the setting block 200B in the toggle glazed curtain wall system, the liner for the PSA 212 is removed from the lower face 210, the setting block 200B is rotated onto the setting block chair 100B until the locking nub 225 slides into a space defined between the upper face 110 and the groove 560 of the horizontal member 550. The setting block 200B is rotated down until the lower face 210 of the setting block 200B contacts the upper face 110 of the setting block chair 100B. Pressure is applied to the top of the setting block 200B to adhere the lower face 210 of the setting block 200B to the upper face 110 of the setting block chair 100B using the PSA 212.

FIG. 5C illustrates a partial vertical cut-away view of a screw spline interface tape toggle glazed curtain wall system according to an embodiment of the present invention, including a horizontal transom 650, insulating glass units (IGU) 500 and a setting block chair 100C and a setting block 200C of the present invention. Each IGU 500 illustrated in FIG. 5C is shown at a 1.000 inch thickness, but it should be understood that the application of an interlocking glass setting block support of the present invention is not limited to any specific thickness IGU. In an embodiment, each IGU 500 comprise two panes of glass lites attached to a structural spacer with a structural adhesive, such as structural silicone adhesive. Each IGU 500 engages an interface channel with a structural adhesive, such as structural silicone adhesive, and a glazing tape, such as acrylic glazing tape. The transom 650 has a groove 660. In an embodiment, the groove 660 has a back edge configured for direct engagement with the back edge 130 of the setting block chair 100C. The transom 650 has a front face 640 for engaging with the back edge 230 of the setting block 200A. Air seal gaskets may be positioned between the transom 650 and the interface. A silicone weatherseal may be positioned between the adjacent edges of the outer glass lite. As illustrated, the setting block chair 100C is rotated so that the engaging area 115 can slide within the groove 660 of the horizontal member 650 of the toggle glazed curtain wall system until the back edge 130 of the setting block chair 100C engages a back edge of the groove 660. Once the back edge 130 engages the back edge of the groove 660, the setting block chair 100C is counter-rotated until the locking nub 125 is locked within a recess 670 of the groove 660. To install the setting block 200C in the toggle glazed curtain wall system, the liner for the PSA 212 is removed from the lower face 210, the setting block 200C is rotated onto the setting block chair 100C until the locking nub 225 slides into a space defined between the upper face 110 and the groove 660 of the horizontal member 650. The setting block 200C is rotated down until the lower face 210 of the setting block 200C contacts the upper face 110 of the setting block chair 100C. Pressure is applied to the top of the setting block 200C to adhere the lower face 210 of the setting block 200C to the upper face 110 of the setting block chair 100C using the PSA 212.

While illustrative embodiments of the invention are disclosed herein, it will be appreciated that numerous modifications and other embodiments may be devised by those skilled in the art. Therefore, it will be understood that the appended claims are intended to cover all such modifications and embodiments that come within the spirit and scope of the present invention.

What is claimed is:

1. A curtain wall system comprising:

a curtain wall comprising:

a plurality of horizontal members stretched between adjacent vertical members, wherein at least one of the horizontal members has a front face, a back face, an upper face and a lower face, and the front face includes a groove cut into the front face; and a setting block assembly comprising:

at least one setting block chair comprising:

a back edge;

an upper face; and a lower face with at least one locking nub; and at least one setting block comprising:

a back edge with at least one locking nub;

an upper face; and a lower face with a pressure sensitive adhesive, wherein the back edge of the setting block chair is positioned within the groove of the horizontal member of the curtain wall, wherein the locking nub of the setting block chair is positioned within a recess in the groove of the horizontal member of the curtain wall, wherein a portion of the upper face of the setting block chair is protruding out from the groove, wherein the setting block is positioned on the upper face of the setting block chair so that the locking nub of the setting block is positioned within the groove of the horizontal member of the curtain wall, the back edge of the setting block engages the front face of the horizontal member, and the pressure sensitive adhesive on the lower face of the setting block adheres the setting block to the upper face of the setting block chair, and wherein, when the setting block is adhered to the setting block chair, the setting block assembly is locked into position on the horizontal member such that the setting block assembly can not be removed from the horizontal member by lifting the setting block assembly or by pulling the setting block assembly.

2. The curtain wall system of claim 1 wherein the locking nub on the lower face of the setting block chair is continuous and spans an entire width of the setting block chair.

3. The curtain wall system of claim 1 wherein a width of the setting block chair is between about four (4) inches and about five (5) inches.

4. The curtain wall system of claim 1 wherein a depth of the setting block chair is between about one (1) inch and about three (3) inches.

5. The curtain wall system of claim 1 wherein the setting block chair is manufactured from a corrosion-resistant material selected from the group consisting of metals and ceramics.

6. The curtain wall system of claim 1 wherein the locking nub on the back edge of the setting block is continuous and spans an entire width of the setting block.

7. The curtain wall system of claim 1 wherein a width of the setting block is between about four (4.0) inches and about five (5.0) inches.

8. The curtain wall system of claim 1 wherein a depth of the setting block is between about one (1) inch and about two-and-a-half (2.5) inches.

9. The curtain wall system of claim 1 wherein the setting block is manufactured from a corrosion-resistant material selected from the group consisting of elastomers, synthetic rubbers and polymers.

10. The curtain wall system of claim 1 wherein the curtain wall is a screw spline toggle glazed curtain wall.

11. The curtain wall system of claim 1 wherein the curtain wall is a screw spline interface toggle glazed curtain wall.

12. The curtain wall system of claim 1 wherein the curtain wall is a screw spline interface tape toggle glazed curtain wall.

13. The curtain wall system of claim 1 further comprising at least two insulating glass units.

* * * * *